US012264388B2

(12) United States Patent
Matsui et al.

(10) Patent No.: US 12,264,388 B2
(45) Date of Patent: Apr. 1, 2025

(54) ELECTRIC-RESISTANCE-WELDED STEEL PIPE OR TUBE FOR HOLLOW STABILIZER AND METHOD OF MANUFACTURING SAME

(71) Applicant: JFE STEEL CORPORATION, Tokyo (JP)

(72) Inventors: Ryoji Matsui, Tokyo (JP); Masatoshi Aratani, Tokyo (JP); Tomonori Kondou, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 698 days.

(21) Appl. No.: 17/593,146

(22) PCT Filed: Feb. 12, 2020

(86) PCT No.: PCT/JP2020/005221
§ 371 (c)(1),
(2) Date: Sep. 10, 2021

(87) PCT Pub. No.: WO2020/189097
PCT Pub. Date: Sep. 24, 2020

(65) Prior Publication Data

US 2022/0186348 A1 Jun. 16, 2022

(30) Foreign Application Priority Data

Mar. 15, 2019 (JP) ..... 2019-048652

(51) Int. Cl.

| | |
|---|---|
| ***C22C 38/16*** | (2006.01) |
| ***C21D 8/10*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/10*** | (2006.01) |
| ***C22C 38/12*** | (2006.01) |

(52) U.S. Cl.
CPC ..... *C22C 38/16* (2013.01); *C21D 8/105* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/105* (2013.01); *C22C 38/12* (2013.01)

(58) Field of Classification Search
CPC ..... C21D 8/105; C21D 9/08; C21D 9/50
See application file for complete search history.

(56) References Cited

U.S. PATENT DOCUMENTS

| | | | |
|---|---|---|---|
| 9,862,014 B2 | 1/2018 | Kawabata et al. | |
| 10,787,720 B2 | 9/2020 | Aratani et al. | |
| 2018/0305780 A1* | 10/2018 | Aratani | C22C 38/002 |

FOREIGN PATENT DOCUMENTS

| | | | |
|---|---|---|---|
| CA | 2991104 | A1 | 4/2017 |
| CN | 108138279 | A | 6/2018 |
| EP | 1371743 | A1 | 12/2003 |
| EP | 3358028 | A1 | 8/2018 |
| EP | 3476953 | B1 | 1/2022 |
| JP | 2003201543 | * | 7/2003 |
| JP | 2003201543 | A | 7/2003 |
| JP | 2005076047 | A | 3/2005 |
| JP | 2006206999 | A | 8/2006 |
| JP | 2007270349 | A | 10/2007 |
| JP | 2008208417 | A | 9/2008 |
| JP | 2013147751 | A | 8/2013 |
| JP | WO2017056384 | * | 4/2017 |
| JP | 2018095899 | A | 6/2018 |
| WO | 2017056384 | A1 | 4/2017 |
| WO | 2018079398 | A1 | 5/2018 |

OTHER PUBLICATIONS

Aug. 16, 2022, Office Action issued by the Canadian Intellectual Property Office in the corresponding Canadian Patent Application No. 3,133,451.
May 19, 2020, International Search Report issued in the International Patent Application No. PCT/JP2020/005221.
Mar. 28, 2022, the Extended European Search Report issued by the European Patent Office in the corresponding European Patent Application No. 20773123.3.
Apr. 29, 2022, Office Action issued by the China National Intellectual Property Administration in the corresponding Chinese Patent Application No. 202080020008.8 with English language search report.
Mar. 28, 2023, Office Action issued by the Korean Intellectual Property Office in the corresponding Korean Patent Application No. 10-2021-7032435 with English language concise statement of relevance.

* cited by examiner

*Primary Examiner* — Nicholas A Wang
(74) *Attorney, Agent, or Firm* — KENJA IP LAW PC

(57) ABSTRACT

Provided is an electric-resistance-welded steel pipe or tube for hollow stabilizer excellent in corrosion fatigue resistance having: a chemical composition containing, in mass %, C: 0.15% or more and less than 0.20%, Si: 0.1% or more and 1.0% or less, Mn: 0.1% or more and 2.0% or less, P: 0.1% or less, S: 0.01% or less, Al: 0.01% or more and 0.10% or less, Ti: more than 0.05% and 0.1% or less, B: 0.0005% or more and 0.005% or less, Ca: 0.0001% or more and 0.0050% or less, and N: 0.0050% or less, with the balance being Fe and inevitable impurities; and a microstructure containing TiS and MnS particles which each have a particle size of 10 μm or more, the TiS and MnS particles having a cleanliness of 0% or more and 0.1% or less as measured by a point counting method according to JIS G 0555.

4 Claims, No Drawings

ELECTRIC-RESISTANCE-WELDED STEEL PIPE OR TUBE FOR HOLLOW STABILIZER AND METHOD OF MANUFACTURING SAME

TECHNICAL FIELD

This disclosure relates to an electric-resistance-welded steel pipe or tube for hollow stabilizer, in particular, an electric-resistance-welded steel pipe or tube for hollow stabilizer which does not contain Cr and has excellent quench crack resistance and corrosion fatigue resistance. This disclosure also relates to a method of manufacturing the same.

BACKGROUND

Almost every automobile is fitted with a stabilizer in order to suppress rolling of the automobile body at the time of cornering and improve driving stability at the time of high-speed driving. As the stabilizer, a solid stabilizer using a bar steel has been conventionally used, but in recent years, for weight reduction, a hollow stabilizer using a steel pipe or tube is generally adopted.

The hollow stabilizer is usually manufactured by cold forming a steel pipe or tube as a material into a desired shape, and then subjecting it to thermal refining treatment such as quenching and tempering. As the steel pipe or tube, for example, a seamless steel pipe or tube and electric-resistance-welded steel pipe or tube are used. Among them, the electric-resistance-welded steel pipe or tube, which is relatively inexpensive and excellent in dimensional accuracy, is widely used.

Such an electric-resistance-welded steel pipe or tube used as a material for a hollow stabilizer (electric-resistance-welded steel pipe or tube for hollow stabilizer) is required to be excellent in strength (hardness) and fatigue resistance after quenching and tempering. Therefore, in order to improve the strength and fatigue resistance after quenching and tempering of the electric-resistance-welded steel pipe or tube for hollow stabilizer, various techniques have been proposed.

For example, JP 2005-076047 A (PTL 1) proposes a technique of manufacturing an electric-resistance-welded steel pipe or tube for hollow stabilizer by subjecting an electric-resistance-welded steel pipe or tube to heat treatment, followed by reduction rolling with a rolling temperature of 600° C. or higher and 850° C. or lower and a cumulative diameter reducing ratio of 40% or more.

Further, J P 2006-206999 A (PTL 2) proposes a technique of controlling the N content and Ti content in an electric-resistance-welded steel pipe or tube for hollow stabilizer so that the N content and Ti content satisfy a specific relationship.

JP 2008-208417 A (PTL 3) proposes an electric-resistance-welded steel pipe or tube for hollow stabilizer having an electric-resistance-welded portion with a bond width of 25 μm or less.

JP 2013-147751 A (PTL 4) proposes an electric-resistance-welded steel pipe or tube for hollow stabilizer having N and Ti contents satisfying a specific relationship and an electric-resistance-welded portion with a bond width of 25 μm or less.

WO2017/056384 A1 (PTL 5) proposes an electric-resistance-welded steel pipe or tube for hollow stabilizer having a predetermined chemical composition and a microstructure in which TiS particles and MnS particles have a cleanliness of 0.1% or less.

CITATION LIST

Patent Literature

PTL 1: JP 2005-076047 A
PTL 2: JP 2006-206999 A
PTL 3: JP 2008-208417 A
PTL 4: JP 2013-147751 A
PTL 5: WO2017/056384 A1

SUMMARY

Technical Problem

The techniques described in PTLs 1 to 5 can improve the strength (hardness) and fatigue resistance after quenching and tempering of an electric-resistance-welded steel pipe or tube for hollow stabilizer.

On the other hand, in cold areas, as measures of preventing road freezing in winter, an antifreezing agent which contains chlorides such as NaCl or $CaCl_2$ is sprayed onto a road surface in order to prevent accidents such as a skidding accident. Therefore, water (for example, snow or ice) containing chlorine ions adheres to the lower part (suspension) of an automobile body, which forms a corrosive environment. Therefore, in recent years, the stabilizer of an automobile is required to have an excellent fatigue resistance in a corrosive environment, that is, corrosion fatigue resistance.

However, although it is possible to improve fatigue resistance in air by using the techniques proposed in PTLs 1 to 4, the techniques do not consider fatigue resistance in a corrosive environment and fail to produce sufficient corrosive fatigue resistance.

On the other hand, the technique proposed in PTL 5 can improve the corrosion fatigue resistance. However, it has been found that the electric-resistance-welded steel pipe or tube disclosed in PTL 5 is likely to have quench cracks during quenching (that is, the quench crack resistance is low). When a member with low quench crack resistance is quenched, it is necessary to use oil having a low cooling rate as a refrigerant to prevent the occurrence of quench cracks, which worsens the working environment. Further, when the member is thick, it is difficult to quench by oil quenching.

Further, in PTL 5, Cr is added to improve the corrosion resistance. Therefore, in the manufacturing process of an electric-resistance-welded steel pipe or tube, when a slab or open pipe or tube is heated, a Fe—Cr—O-based internal oxidation layer is formed, resulting in reduced descaling properties. When the descaling properties are low, scales remaining on the surface will be pushed in during a rolling process, causing surface indentation flaws. As a result, the durability of a stabilizer as a final product may be adversely affected.

To address these issues, it could thus be helpful to provide an electric-resistance-welded steel pipe or tube for hollow stabilizer which does not contain Cr and has excellent quench crack resistance and corrosion fatigue resistance.

The expression of "the electric-resistance-welded steel pipe or tube for hollow stabilizer having excellent corrosion fatigue properties" means that the electric-resistance-welded steel pipe or tube after being subjected to quenching and tempering exhibits excellent fatigue resistance under a corrosive environment.

Solution to Problem

To achieve the object described above, we have made studies on different factors that affect the corrosion fatigue resistance of the hollow stabilizer.

As a result, it has been found that an electric-resistance-welded steel pipe or tube for hollow stabilizer having both excellent quench crack resistance and corrosion fatigue resistance can be obtained even without adding Cr by controlling the chemical composition and microstructure so as to satisfy predetermined conditions.

This disclosure is based on the aforementioned findings, and we provide the following.

1. An electric-resistance-welded steel pipe or tube for hollow stabilizer comprising:
   - a chemical composition containing (consisting of), in mass %,
   - C: 0.15% or more and less than 0.20%,
   - Si: 0.1% or more and 1.0% or less,
   - Mn: 0.1% or more and 2.0% or less,
   - P: 0.1% or less,
   - S: 0.01% or less,
   - Al: 0.01% or more and 0.10% or less,
   - Ti: more than 0.05% and 0.1% or less,
   - B: 0.0005% or more and 0.005% or less,
   - Ca: 0.0001% or more and 0.0050% or less, and
   - N: 0.0050% or less, with the balance being Fe and inevitable impurities; and
   - a microstructure in which a cleanliness with respect to TiS particles with a particle size of 10 μm or more and a cleanliness with respect to MnS particles with a particle size of 10 μm or more are 0% or more and 0.1% or less, respectively, the cleanliness being measured by a point counting method according to JIS G 0555.

2. The electric-resistance-welded steel pipe or tube for hollow stabilizer according to 1., wherein the chemical composition further contains, in mass %, at least one selected from the group consisting of
   - Cu: 1% or less,
   - Ni: 1% or less,
   - Nb: 0.05% or less,
   - W: 0.05% or less,
   - V: 0.5% or less, and
   - REM: 0.02% or less.

3. A method of manufacturing the electric-resistance-welded steel pipe or tube for hollow stabilizer according to 1. or 2., comprising:
   - cold forming a steel plate having the chemical composition into an open pipe or tube having an approximately cylindrical shape;
   - subjecting the open pipe or tube to electric resistance welding with its widthwise ends butted against each other to obtain an electric-resistance-welded steel pipe or tube;
   - heating the electric-resistance-welded steel pipe or tube to a heating temperature of 850° C. or higher and 1000° C. or lower; and
   - subjecting the heated electric-resistance-welded steel pipe or tube to hot-diameter-reducing rolling under a set of conditions including a rolling temperature of 650° C. or higher and a cumulative diameter reducing ratio of 30% or more and 90% or less.

Advantageous Effect

According to this disclosure, it is possible to provide an electric-resistance-welded steel pipe or tube for hollow stabilizer which does not contain Cr and has excellent quench crack resistance and corrosion fatigue resistance. The electric-resistance-welded steel pipe or tube for hollow stabilizer has a Cr content limited to less than 0.20 mass % and thus has excellent quench crack resistance. Therefore, the electric-resistance-welded steel pipe or tube for hollow stabilizer can be quenched without cracks even in water quenching. Further, the electric-resistance-welded steel pipe or tube for hollow stabilizer does not contain Cr which deteriorates descaling properties, and thus has excellent descaling properties. In addition, the electric-resistance-welded steel pipe or tube for hollow stabilizer has excellent corrosion fatigue resistance even though it does not contain Cr.

Furthermore, the electric-resistance-welded steel pipe or tube for hollow stabilizer can be used to manufacture a hollow stabilizer having a Vickers hardness of 350 HV or more and excellent corrosion fatigue resistance. Besides, even when the Vickers hardness is further increased to 450 HV or more, the corrosion fatigue resistance is not deteriorated and the excellent performance is maintained. Therefore, according to this disclosure, the wall thickness of the stabilizer can be further reduced.

DETAILED DESCRIPTION

This disclosure is described in detail below. Note that this disclosure is not limited to the following embodiments.

[Chemical Composition]

An electric-resistance-welded steel pipe or tube for hollow stabilizer according to one embodiment of this disclosure has the aforementioned chemical composition. Hereinafter, the reasons for limiting the chemical composition are described. As used herein, "%" as the unit of the content of each element refers to "mass %" unless otherwise noted.

C: 0.15% or More and Less than 0.20%

C is an important element for securing the strength (hardness) of the hollow stabilizer because C has an action of promoting the formation of martensite through the improvement of quench hardenability and dissolving in steel to increase the strength (hardness) of the steel. In order to achieve a Vickers hardness of 350 HV or more after quenching and tempering, the C content needs to be 0.15% or more. Therefore, the C content is set to 0.15% or more and preferably 0.17% or more. On the other hand, when the C content is 0.20% or more, the risk of quench cracking is increased and additionally the toughness after quenching is reduced. Therefore, the C content is set to less than 0.20% and preferably 0.19% or less.

Si: 0.1% or More and 1.0% or Less

Si acts as a deoxidizer and also acts as a solid-solution-strengthening element. To obtain such effects, the Si content needs to be 0.1% or more. Therefore, the Si content is set to 0.1% or more. On the other hand, when the Si content exceeds 1.0%, the electric resistance weldability is deteriorated. Therefore, the Si content is set to 1.0% or less, preferably 0.75% or less, more preferably 0.5% or less, and further preferably 0.20% or less.

Mn: 0.1% or More and 2.0% or Less

Mn is an element that dissolves into steel to contribute to higher strength of the steel and improves the quench hardenability of the steel. To ensure a desired strength, the Mn content needs to be 0.1% or more. Further, when the Mn content is less than 0.1%, S in the steel easily combines with Ti, resulting in coarsening of TiS. Therefore, the Mn content is set to 0.1% or more, preferably 0.3% or more, and more preferably 0.5% or more. On the other hand, a Mn content beyond 2.0% deteriorates toughness and additionally increases the risk of quench cracking. Therefore, the Mn content is set to 2.0% or less, preferably 1.8% or less, and more preferably 1.5% or less.

P: 0.1% or Less

P is an element contained in the steel as an impurity and segregates to grain boundaries or the like to adversely affect weld cracking resistance and toughness. Therefore, the P content is set to 0.1% or less and preferably 0.05% or less. On the other hand, from the viewpoint of weld cracking resistance and toughness, the P content is desirably as low as possible. Accordingly, no lower limit is placed on the P content and the P content may be 0. However, an excessive reduction of the P content increases manufacturing costs. Therefore, from the viewpoint of cost reduction, the P content is preferably set to 0.001% or more, more preferably 0.005% or more, and further preferably 0.010% or more.

S: 0.01% or Less

S is an element that exists as sulfide inclusions in the steel and deteriorates hot workability, toughness, and fatigue resistance. Therefore, the S content is set to 0.01% or less and preferably 0.005% or less. On the other hand, from the viewpoint of hot workability, toughness, and fatigue resistance, the S content is desirably as low as possible. Accordingly, no lower limit is placed on the S content and the S content may be 0. However, an excessive reduction of the S content increases manufacturing costs. Therefore, from the viewpoint of cost reduction, the S content is preferably set to 0.0001% or more, more preferably 0.0005% or more, and further preferably 0.001% or more.

Al: 0.01% or More and 0.10% or Less

Al acts as a deoxidizer and has an effect of ensuring the amount of solute B which is effective in improving quench hardenability by combining with N. Further, Al precipitates as MN and has an action of preventing coarsening of austenite grains during quenching heating. In order to obtain such effects, the Al content needs to be 0.01% or more. Therefore, the Al content is set to 0.01% or more and preferably 0.02% or more. On the other hand, when the Al content exceeds 0.10%, the amount of oxide-based inclusions is increased to decrease fatigue life. Accordingly, the Al content is set to 0.10% or less and preferably 0.05% or less.

Ti: More than 0.05% and 0.1% or Less

Ti has an effect of ensuring the amount of solute B which is effective in improving quench hardenability by combining with N. Further, Ti precipitates as fine carbides, contributes to refining austenite grains during heat treatment such as quenching, and to improving fatigue resistance in a corrosive environment (corrosion fatigue resistance). To obtain such effects, the Ti content needs to be more than 0.05%. Further, when the Ti content is 0.05% or less, S in the steel tends to combine with Mn, relatively leading to coarsening of MnS. Therefore, the Ti content is set to more than 0.05%, preferably 0.051% or more, and more preferably 0.052% or more. On the other hand, when the Ti content exceeds 0.1%, coarse titanium sulfide (TiS) acting as a starting point of a corrosion pit is formed, deteriorating corrosion resistance and corrosion fatigue resistance. Therefore, the Ti content is set to 0.1% or less, preferably 0.091% or less, and more preferably 0.061% or less.

B: 0.0005% or More and 0.005% or Less

B is an element that has an effect of improving the quench hardenability of the steel when added in a trace quantity. Further, B has an effect of strengthening prior austenite grain boundaries and suppressing grain boundary embrittlement due to P segregation, and as a result, suppressing fatigue crack propagation. To obtain such effects, the B content is set to 0.0005% or more, and preferably 0.001% or more. On the other hand, adding B exceeding 0.005% fails to increase the effect but is rather economically disadvantageous. Therefore, the B content is set to 0.005% or less and preferably 0.003% or less.

Ca: 0.0001% or More and 0.0050% or Less

Ca is an element that has an effect of controlling the morphology of sulfide inclusions to make them fine and approximately spherical in shape. In this disclosure, in order to reduce the number of MnS particles with a particle size of 10 μm or more and TiS particles with a particle size of 10 μm or more which act as a starting point of a corrosion pit, it is necessary to add Ca in an amount of 0.0001% or more. Therefore, the Ca content is set to 0.0001% or more and preferably 0.001% or more. On the other hand, the Ca content beyond 0.0050% excessively increases coarse CaS clusters, which act as starting points of fatigue cracks, deteriorating corrosion fatigue resistance. Therefore, the Ca content is set to 0.0050% or less and preferably 0.0030% or less.

N: 0.0050% or Less

N is an element inevitably contained as an impurity. N combines with nitride forming elements in the steel to contribute to suppressing coarsening of crystallized grains and increasing strength after tempering. However, a N content beyond 0.0050% deteriorates the toughness of a welded portion. Therefore, the N content is set to 0.0050% or less and preferably 0.003% or less. On the other hand, no lower limit is placed on the N content and the N content may be 0. However, the effects can be obtained by adding a certain amount of N. Further, an excessive reduction of the N content results in an increase in manufacturing costs. Therefore, from these viewpoints, the N content is preferably set to 0.001% or more and more preferably 0.002% or more.

An electric-resistance-welded steel pipe or tube for hollow stabilizer according to one embodiment of this disclosure has a chemical composition comprising the aforementioned elements with the balance being Fe and inevitable impurities. An electric-resistance-welded steel pipe or tube for hollow stabilizer according to one embodiment of this disclosure can have a chemical composition consisting of the aforementioned elements with the balance being Fe and inevitable impurities.

The chemical composition of the electric-resistance-welded steel pipe or tube for hollow stabilizer according to another embodiment of this disclosure may optionally further contain at least one selected from the group consisting of Cu, Ni, Nb, W, V, and REM (rare earth metals) in the amounts described below.

Cu: 1% or Less

Cu is an element that further improves quench hardenability and corrosion resistance. However, because Cu is an expensive element, a Cu content beyond 1% significantly increases material costs. Therefore, in the case of adding Cu, the Cu content is set to 1% or less, preferably 0.50% or less, and more preferably 0.40% or less. On the other hand, no lower limit is placed on the Cu content. However, when Cu is added, in order to enhance the effect of adding Cu, the Cu content is preferably set to 0.05% or more and preferably 0.10% or more.

Ni: 1% or Less

As with Cu, Ni is an element that further improves quench hardenability and corrosion resistance. However, because Ni is an expensive element, a Ni content beyond 1% significantly increases material costs. Therefore, in the case of adding Ni, the Ni content is set to 1% or less, preferably 0.50% or less, and more preferably 0.40% or less. On the other hand, no lower limit is placed on the Ni content. However, when Ni is added, in order to enhance the effect of adding Ni, the Ni content is set to 0.05% or more and preferably 0.10% or more.

Nb: 0.05% or Less

Nb is an element that forms fine carbides to contribute to higher strength (hardness). However, a Nb content beyond 0.05% does not increase the effect of adding Nb and thus fails to offer an effect commensurate with the content, which is economically disadvantageous. Therefore, in the case of adding Nb, the Nb content is set to 0.05% or less and preferably 0.03% or less. On the other hand, no lower limit is placed on the Nb content. However, when Nb is added, in order to increase the effect of adding Nb, the Nb content is preferably set to 0.001% or more and more preferably 0.005% or more.

W: 0.05% or Less

As with Nb, W is an element that forms fine carbides to contribute to higher strength (hardness). However, a W content beyond 0.05% does not increase the effect of adding W and thus fails to offer an effect commensurate with the content, which is economically disadvantageous. Therefore, in the case of adding W, the W content is set to 0.05% or less and preferably 0.03% or less. On the other hand, no lower limit is placed on the W content. However, when W is added, in order to enhance the effect of adding W, the W content is preferably set to 0.01% or more.

V: 0.5% or Less

As with Nb and W, V is an element that forms fine carbides to contribute to higher strength (hardness). However, a V content beyond 0.5% does not increase the effect of adding V and thus fails to offer an effect commensurate with the content, which is economically disadvantageous. Therefore, in the case of adding V, the V content is set to 0.5% or less and preferably 0.3% or less. On the other hand, no lower limit is placed on the V content. However, when V is added, in order to enhance the effect of adding V, the V content is preferably set to 0.05% or more.

REM: 0.02% or Less

As with Ca, REM is an element that has an effect of controlling the morphology of sulfide inclusions to make them fine and approximately spherical in shape. In this disclosure, from the viewpoint of complementing the Ca effect, it is preferable to add REM. However, a REM content beyond 0.02% excessively increases the amount of inclusions which act as starting points of fatigue cracks, deteriorating corrosion fatigue resistance. Therefore, in the case of adding REM, the REM content is set to 0.02% or less, preferably 0.01% or less, and more preferably 0.008% or less. On the other hand, no lower limit is placed on the REM content, but from the viewpoint of enhancing the effect of adding REM, the REM content is preferably set to 0.001% or more.

The electric-resistance-welded steel pipe or tube for hollow stabilizer according to one embodiment of this disclosure can have a chemical composition consisting of C: 0.15% or more and less than 0.20%,
Si: 0.1% or more and 1.0% or less,
Mn: 0.1% or more and 2.0% or less,
P: 0.1% or less,
S: 0.01% or less,
Al: 0.01% or more and 0.10% or less,
Ti: more than 0.05% and 0.1% or less,
B: 0.0005% or more and 0.005% or less,
Ca: 0.0001% or more and 0.0050% or less,
N: 0.0050% or less, and
optionally at least one selected from the group consisting of Cu: 1% or less, Ni: 1% or less, Nb: 0.05% or less, W: 0.05% or less, V: 0.5% or less, and REM: 0.02% or less, with the balance being Fe and inevitable impurities.

The chemical composition of the electrical-resistance-welded steel pipe or tube for hollow stabilizer of this disclosure does not contain Cr. When Cr is added, the formation of a Fe—Cr—O-based internal oxidation layer in a process of heating a slab or pipe (prior to diameter-reducing rolling) deteriorates descaling properties, which may cause surface indentation flaws of scales in the rolling step and thus negatively affect the durability of a stabilizer as a final product. However, even in this disclosure, it is acceptable that the above chemical composition contains Cr as an inevitable impurity. The Cr content as an inevitable impurity is preferably set to less than 0.01% and more preferably 0.050% or less.

[Microstructure]

The electric-resistance-welded steel pipe or tube for hollow stabilizer of this disclosure further has a microstructure in which a cleanliness with respect to TiS particles with a particle size of 10 μm or more and a cleanliness with respect to MnS particles with a particle size of 10 μm or more are 0% or more and 0.1% or less, respectively, the cleanliness being measured by a point counting method according to JIS G 0555. The reasons for limiting the microstructure in this way are given below.

The TiS particles with a particle size of 10 μm or more and the MnS particles with a particle size of 10 μm or more act as a starting point of a corrosion pit, deteriorating corrosion resistance. Further, the TiS particles with a particle size of 10 μm or more and the MnS particles with a particle size of 10 μm or more promote the occurrence of fatigue cracks starting from corrosion pits, and thus corrosion fatigue resistance is deteriorated. Specifically, when at least one of the cleanliness with respect to TiS particles with a particle size of 10 μm or more and the cleanliness with respect to MnS particles with a particle size of 10 μm or more is more than 0.1%, the corrosion resistance and corrosion fatigue resistance are deteriorated. Therefore, the cleanliness of each of the TiS particles with a particle size of 10 μm or more and the MnS particles with a particle size of 10 μm or more is set to 0.1% or less. On the other hand, because the cleanliness is preferably as low as possible, the cleanliness is set to 0 or more. As used herein, the "particle size" refers to the maximum length of a particle. The cleanliness refers to a value measured in a center position in the plate thickness direction of the steel pipe or tube. The cleanliness can be measured by the method described in the EXAMPLES section below.

In order to set the cleanliness to 0% or more and 0.1% or less, it is important to control the Ca content within the aforementioned range.

Further, when REM is added, it is also important to control the REM content within the above range.

[t/D]

Although the size of the electric-resistance-welded steel pipe or tube for hollow stabilizer is not particularly limited and may be any size, the ratio of the wall thickness t (mm) to the outer diameter D (mm) of the steel pipe or tube represented by t/D is preferably set to 7% or more. t/D may be 10% or more and may be 12% or more. On the other hand, t/D is preferably 35% or less. t/D may be 30% or less and may be 25% or less.

[Manufacturing Method]

The method of manufacturing the electric-resistance-welded steel pipe or tube for hollow stabilizer of this disclosure is not particularly limited and any method may be used. The following describes a suitable manufacturing method of the electric-resistance-welded steel pipe or tube for hollow stabilizer of one embodiment of this disclosure.

The electric-resistance-welded steel pipe or tube for hollow stabilizer of this disclosure can be manufactured by sequentially subjecting a steel plate having the aforementioned chemical composition to the following steps (1) to (4).

(1) Cold forming (2) Electric resistance welding (3) Heating (4) Diameter-reducing hot rolling (1) Cold Forming First, a steel plate having the aforementioned chemical composition is subjected to cold forming to obtain an open pipe or tube having an approximately cylindrical shape. The method of cold forming is not particularly limited, and for example, a conventional method may be used. Specifically, the steel plate is preferably subjected to continuous cold rolling using a plurality of rolls.

(2) Electric Resistance Welding

Then, the open pipe or tube is subjected to electric resistance welding with its widthwise ends butted against each other to obtain an electric-resistance-welded steel pipe or tube. Although the widthwise ends of the open pipe or tube can be butted against each other by any method, squeeze rolls can be typically used. Further, the electric resistance welding is preferably performed by, for example, high frequency resistance welding or induction heating welding.

(3) Heating

Then, the obtained electric-resistance-welded steel pipe or tube is heated to a heating temperature of 850° C. or higher and 1000° C. or lower. When the heating temperature is lower than 850° C., a desired toughness of the welded portion may not be ensured. Therefore, the heating temperature is set to 850° C. or higher and preferably 860° C. or higher. On the other hand, a heating temperature beyond 1000° C. causes significant surface decarburization, sometimes deteriorating surface texture. Therefore, the heating temperature is set to 1000° C. or lower and preferably 980° C. or lower.

(4) Diameter-Reducing Hot Rolling

Further, the heated electric-resistance-welded steel pipe or tube is subjected to hot diameter-reducing rolling under a set of conditions including a rolling temperature of 650° C. or higher and a cumulative diameter reducing ratio of 30% or more and 90% or less. When the rolling temperature is lower than 650° C., the workability may be reduced, which makes it difficult to form the electric-resistance-welded steel pipe or tube into a desired stabilizer shape. No upper limit is placed on the rolling temperature, but in reality, the rolling temperature is at or below the heating temperature. Further, a cumulative diameter reducing ratio of 30% or more and 90% or less does not deteriorate the workability of the electric-resistance-welded steel pipe or tube, and the electric-resistance-welded steel pipe or tube can be formed into a desired stabilizer shape. The cumulative diameter reducing ratio is preferably set to 35% or more. The cumulative diameter reducing ratio is preferably set to 80% or less.

(Hollow Stabilizer)

The electric-resistance-welded steel pipe or tube for hollow stabilizer of this disclosure can be suitably used as a material for manufacturing a hollow stabilizer. The method of manufacturing the hollow stabilizer is not particularly limited and any method may be used. Generally, a hollow stabilizer can be made by forming the electric-resistance-welded steel pipe or tube for hollow stabilizer into a stabilizer shape and subjecting it to heat treatment.

In the forming step, the electric-resistance-welded steel pipe or tube for hollow stabilizer is formed into a stabilizer shape. As the forming method, any regular forming method can be used. From the viewpoint of suppressing the surface decarburization, the forming step is preferably performed by cold bending. Examples of the cold bending includes rotary draw-bending and press bending.

Then, the member which has been formed into a stabilizer shape (hollow stabilizer) is subjected to heat treatment. The heat treatment is preferably performed in a quenching process or quenching-tempering processes.

After the heat treatment, one or both of the inner and outer surfaces of the pipe or tube is preferably subjected to shot blasting treatment in order to improve fatigue resistance.

The stabilizer manufactured using the electric-resistance-welded steel pipe or tube for hollow stabilizer of this disclosure has the following: the aforementioned chemical composition; a microstructure containing TiS particles with a particle size of 10 μm or more and MnS particles with a particle size of 10 μm or more, in which the TiS particles and the MnS particles have a cleanliness of 0% or more and 0.1% or less as measured by a point counting method according to JIS G 0555; prior austenite grains having an average grain size of 50 μm or less; and a Vickers hardness of 400 HV or more and less than 550 HV. That is, the chemical composition and cleanliness of the electric-resistance-welded steel pipe or tube for hollow stabilizer is maintained in the hollow stabilizer after the quenching-tempering processes.

EXAMPLES

The action and effect according to this disclosure are described below by way of examples. Note that this disclosure is not limited to the following examples.

Example 1

An electric-resistance-welded steel pipe or tube for hollow stabilizer was prepared according to the following procedure.

First, molten steels having the chemical compositions listed in Table 1 were used to manufacture steel slabs by continuous casting. Each steel slab was hot rolled to obtain a hot-rolled steel plate having a plate thickness of 4.5 mm. The cleanliness of steel is affected not only by a chemical composition and steelmaking conditions. Therefore, in manufacturing the steel slab by continuous casting, the temperature of the molten steel and casting speed were made constant.

Then, the hot-rolled steel plate was subjected to continuous cold forming using a plurality of rolls to obtain an approximately cylindrical open pipe or tube. Next, circumferential ends of the open pipe or tube were butted and pressed against each other and subjected to electric resistance welding using a high-frequency electric resistance welding method to obtain an electric-resistance-welded steel pipe or tube (89.1 mmφ in outer diameter×4.5 mm in thickness). Then, the obtained electric-resistance-welded steel pipe or tube was heated to the heating temperature of 980° C. by induction heating. Next, the heated electric-resistance-welded steel pipe or tube was subjected to hot-diameter-reducing rolling to obtain an electric-resistance-welded steel pipe or tube for hollow stabilizer. The hot diameter-reducing rolling was performed under a set of conditions including the diameter-reducing rolling temperature of 800° C. and the diameter reducing ratio of 71%. The diameter-reducing rolling temperature was measured at the delivery side of a final rolling stand by using a radiation thermometer. The dimension of the final electric-resistance-welded steel pipe or tube for hollow stabilizer was from 21.7 mmφ to 54 mmφ in outer diameter×4.0 mm in thickness.

(Cleanliness)

Then, for the obtained electric-resistance-welded steel pipe or tube for hollow stabilizer, the microstructure was observed by the following procedure, and the cleanliness was determined by the point counting method according to JIS G 0555.

First, a test piece for microstructure observation was collected from the obtained electric-resistance-welded steel pipe or tube for hollow stabilizer so that a cross section parallel to the pipe or tube axial direction of the test piece was an observation surface. Next, the surface of a central part in the thickness direction of the test piece for microstructure observation was observed using a scanning electron microscope (from 500 to 2000 magnifications), and the type, size, and number of inclusion particles present in the surface were determined. The types (compositions) of the inclusion particles were identified by analyzing the elements constituting the inclusion particles using an energy-dispersive X-ray analyzer (EDX analyzer) attached to the scanning electron microscope. Further, the maximum length of the particles in the cross section (observation surface) was used as the particle size of the particles. Then, for the TiS particles and MnS particles, the numbers of Tis and MnS particles with a particle size of 10 μm or more were measured. From the obtained numbers of particles, the area ratio (%) of the inclusions was calculated using the point counting method according to JIS G 0555, and the average value of the area ratios in 60 fields of view was used as the cleanliness.

(Quenching and Tempering)

Next, in order to evaluate the properties after quenching and tempering, each of the obtained electric-resistance-welded steel pipes or tubes for hollow stabilizer was subjected to quenching and tempering processes under the following conditions.

First, the electric-resistance-welded steel pipe or tube for hollow stabilizer was heated by electrical resistance heating until the surface temperature became 950° C. The electrical resistance heating was performed by clamping both ends in the longitudinal direction of the electric-resistance-welded steel pipe or tube with electrodes and applying electric current between the electrodes. Further, the surface temperature was measured by a radiation thermometer. Then, after being held at 950° C. for 3 seconds, the electric-resistance-welded steel pipe or tube for hollow stabilizer was quenched by putting it into a quenching bath (water) and quenching it at a cooling rate of 80±10° C./s.

Further, the electric-resistance-welded steel pipe or tube for hollow stabilizer was tempered by holding it at a tempering temperature of 350° C. for 20 minutes. The tempering temperature was measured by attaching a thermocouple to the steel pipe or tube.

In the actual manufacturing of a stabilizer, the electric-resistance-welded steel pipe or tube is formed into a stabilizer shape by cold working before being subjected to quenching and tempering processes. However, the cold working does not affect the average particle size and Vickers hardness of prior austenite grains. Therefore, in the example, the electric-resistance-welded steel pipe or tube was subjected to the quenching and tempering processes without cold working.

(Vickers Hardness)

In order to evaluate the strength after the quenching and tempering processes, a test piece was collected from the electric-resistance-welded steel pipe or tube after the quenching and tempering processes to measure the Vickers hardness in a cross section (C section) perpendicular to the pipe or tube axis direction of the steel pipe or tube using a Vickers hardness meter. In the measurement, the Vickers hardness was measured at a pitch of 0.1 mm over the entire thickness of the cross section from the outer surface to the inner surface of the pipe or tube, and the measurement results were averaged. The Vickers hardness was measured under a load of 500 gf (4.9 N).

(Prior γ Grain Size)

In the electric-resistance-welded steel pipe or tube after the quenching and tempering processes, the prior austenite grain size (prior γ grain size) was measured in the following procedures.

First, a test piece was collected from the electric-resistance-welded steel pipe or tube after the quenching and tempering processes so that a cross section orthogonal to the pipe or tube axis direction was an observation surface. The cross section was polished and then etched with etching solution (picric acid aqueous solution) to expose prior austenite grain boundaries. Thereafter, the cross section was observed by an optical microscope (100 magnifications) and was imaged for 10 or more observation fields. The obtained microstructure photographs were subjected to image analysis to calculate the average grain size of the prior austenite grains.

(Corrosion Fatigue Resistance)

In order to evaluate the corrosion fatigue resistance of the electric-resistance-welded steel pipe or tube after the quenching and tempering processes, a fatigue test was conducted according to the following procedure to determine the fatigue life.

First, a test body with a predetermined length was collected from the electric-resistance-welded steel pipe or tube for hollow stabilizer before the quenching and tempering processes and processed into a test piece for a corrosion fatigue test. In a central part of the test piece, a parallel portion with an outer diameter of 24.4 mmφ was formed. Then, the test piece was subjected to the quenching and tempering processes. In the quenching and tempering processes, first, the test piece was heated to a surface temperature of 950° C. by induction heating, held for 3 seconds, and then quenched by spraying water at a cooling rate of 80° C./s. After the quenching process, the test piece was tempered with a holding temperature of 350° C. for 20 minutes.

After the quenching and tempering processes, the test piece was wetted by wrapping the central parallel portion with absorbent cotton soaked with 5% NaCl solution and subjected to a fatigue test, in which the number of cycles until the occurrence of cracks was determined to evaluate corrosion fatigue resistance. The test conditions were a load stress of ±400 MPa (reversed stress) and a load frequency of 1 Hz. The fatigue life thus obtained can be regarded as an indicator of corrosion fatigue resistance.

The obtained results are listed in Table 2. Compared with the comparative examples, the electric-resistance-welded steel pipe or tube for hollow stabilizer satisfying the conditions of this disclosure had a small prior austenite grain size after the quenching and tempering processes and also had excellent corrosion fatigue resistance after the quenching and tempering processes. The smaller prior austenite grain size increases grain boundaries, which can prevent crack propagation. In addition, when the prior austenite grains are refined, the effect of hydrogen embrittlement on corrosion fatigue resistance can be suppressed to improve the corrosion fatigue resistance. Therefore, a stabilizer obtained by using the electric-resistance-welded steel pipe or tube for hollow stabilizer of this disclosure has excellent resistance to crack propagation and thus high fatigue strength.

TABLE 1

| Steel sample | Chemical composition (mass %) * | | | | | | | | | | | | | | | | |
|---|---|---|---|---|---|---|---|---|---|---|---|---|---|---|---|---|---|
| ID | C | Si | Mn | P | S | Al | Ti | B | Ca | N | Cu | Ni | Nb | W | V | REM | Remarks |
| A | 0.19 | 0.11 | 1.1 | 0.015 | 0.0021 | 0.03 | 0.051 | 0.0025 | 0.0020 | 0.0025 | — | — | — | — | — | — | Conforming steel |
| B | 0.18 | 0.19 | 1.1 | 0.015 | 0.0021 | 0.011 | 0.051 | 0.0025 | 0.0002 | 0.0025 | 0.2 | — | — | — | — | — | Conforming steel |
| C | 0.16 | 0.19 | 0.5 | 0.015 | 0.0021 | 0.03 | 0.052 | 0.0025 | 0.0005 | 0.0025 | 0.1 | 0.2 | — | — | — | — | Conforming steel |
| D | 0.15 | 0.17 | 1.2 | 0.011 | 0.002 | 0.03 | 0.053 | 0.0024 | 0.0011 | 0.003 | — | — | — | — | — | — | Conforming steel |
| E | 0.19 | 0.17 | 1.2 | 0.011 | 0.002 | 0.03 | 0.054 | 0.0024 | 0.0025 | 0.003 | 0.2 | — | — | — | — | — | Conforming steel |
| F | 0.18 | 0.17 | 1.2 | 0.011 | 0.002 | 0.03 | 0.051 | 0.0024 | 0.0030 | 0.003 | 0.1 | 0.2 | — | — | — | — | Conforming steel |
| G | 0.19 | 0.17 | 1.2 | 0.011 | 0.002 | 0.09 | 0.052 | 0.0024 | 0.0035 | 0.003 | — | — | 0.01 | — | — | 0.002 | Conforming steel |
| H | 0.19 | 0.17 | 1.2 | 0.011 | 0.002 | 0.03 | 0.052 | 0.0024 | 0.0040 | 0.003 | — | — | — | 0.03 | 0.1 | 0.002 | Conforming steel |
| I | 0.18 | 0.17 | 1.4 | 0.011 | 0.002 | 0.03 | 0.056 | 0.0024 | 0.0045 | 0.003 | — | — | — | — | — | — | Conforming steel |
| J | 0.18 | 0.17 | 1.4 | 0.011 | 0.002 | 0.03 | 0.061 | 0.0024 | 0.0020 | 0.003 | 0.2 | — | — | — | — | — | Conforming steel |
| K | 0.19 | 0.75 | 1.4 | 0.011 | 0.002 | 0.03 | 0.091 | 0.0024 | 0.0022 | 0.003 | 0.1 | 0.2 | — | — | — | — | Conforming steel |
| L | 0.14 | 0.17 | 1.2 | 0.011 | 0.002 | 0.03 | 0.051 | 0.0024 | 0.0020 | 0.003 | 0.1 | 0.2 | — | — | — | — | Comparative steel |
| M | 0.21 | 0.17 | 1.2 | 0.011 | 0.002 | 0.03 | 0.064 | 0.0024 | 0.0020 | 0.003 | 0.1 | 0.2 | — | — | — | — | Comparative steel |
| N | 0.16 | 0.17 | 2.1 | 0.011 | 0.002 | 0.03 | 0.052 | 0.0024 | 0.0020 | 0.003 | 0.1 | 0.2 | — | — | — | — | Comparative steel |
| O | 0.19 | 0.17 | 1.2 | 0.011 | 0.015 | 0.03 | 0.056 | 0.0024 | 0.0020 | 0.003 | 0.1 | 0.2 | — | — | — | — | Comparative steel |
| P | 0.19 | 0.17 | 0.08 | 0.011 | 0.002 | 0.03 | 0.056 | 0.0024 | 0.0020 | 0.003 | 0.1 | 0.2 | — | — | — | — | Comparative steel |
| Q | 0.19 | 0.17 | 1.4 | 0.011 | 0.002 | 0.03 | 0.11 | 0.0024 | 0.0020 | 0.003 | 0.1 | 0.2 | — | — | — | — | Comparative steel |
| R | 0.19 | 0.17 | 1.4 | 0.011 | 0.002 | 0.11 | 0.056 | 0.0024 | 0.0020 | 0.003 | 0.1 | 0.2 | — | — | — | — | Comparative steel |
| S | 0.19 | 0.17 | 1.2 | 0.011 | 0.002 | 0.03 | 0.04 | 0.0024 | 0.0020 | 0.003 | 0.1 | 0.2 | — | — | — | — | Comparative steel |

* The balance is Fe and inevitable impurities.

TABLE 2

| | Steel sample | Steel pipe or tube after quenching and tempering | | | | | |
|---|---|---|---|---|---|---|---|
| | | Microstructure of steel pipe or tube Cleanliness (%) | | Average Vickers | Prior γ grain size | Corrosion fatigue life (cycle) in 5% NaCl | |
| No. | ID | TiS | MnS | hardness | (μm) | solution | Remarks |
| 1 | A | 0.04 | 0.05 | 430 | 25 | 528410 | Example |
| 2 | B | 0.06 | 0.04 | 420 | 26 | 534410 | Example |
| 3 | C | 0.03 | 0.05 | 430 | 25 | 548410 | Example |
| 4 | D | 0.04 | 0.03 | 410 | 22 | 525840 | Example |
| 5 | E | 0.05 | 0.05 | 430 | 18 | 525710 | Example |
| 6 | F | 0.02 | 0.04 | 420 | 21 | 560160 | Example |
| 7 | G | 0.03 | 0.02 | 430 | 18 | 562140 | Example |
| 8 | H | 0.04 | 0.05 | 410 | 19 | 548460 | Example |
| 9 | I | 0.03 | 0.05 | 420 | 18 | 518420 | Example |
| 10 | J | 0.05 | 0.04 | 420 | 16 | 506750 | Example |
| 11 | K | 0.04 | 0.05 | 430 | 14 | 586420 | Example |
| 12 | L | 0.05 | 0.05 | 360 | 56 | 285530 | Comparative example |
| 13 | M | 0.05 | 0.05 | 490 | 58 | 268970 | Comparative example |
| 15 | N | 0.05 | 0.30 | 440 | 60 | 255460 | Comparative example |
| 16 | O | 0.20 | 0.30 | 450 | 49 | 287420 | Comparative example |
| 17 | P | 0.20 | 0.02 | 420 | 50 | 252650 | Comparative example |
| 18 | Q | 0.25 | 0.05 | 420 | 43 | 245620 | Comparative example |
| 19 | R | 0.05 | 0.05 | 410 | 46 | 213560 | Comparative example |
| 20 | S | 0.02 | 0.28 | 420 | 50 | 185960 | Comparative example |

Example 2

Hot-rolled steel plates with the chemical compositions listed in the columns of steel sample IDs A, B, and C in Table 1 were used to make electric-resistance-welded steel pipes or tubes for hollow stabilizer under the conditions listed in Table 3. Other conditions were the same as in Example 1.

Then, using the same procedures as in Example 1, the cleanliness, Vickers hardness after the quenching and tempering processes, prior austenite grain size, and corrosion fatigue resistance were evaluated. The evaluation results are listed in Table 4.

As is clear from the results listed in Table 4, under the manufacturing conditions specified in this disclosure, an electric-resistance-welded-steel pipe or tube for hollow stabilizer which has corrosion fatigue life of more than 500,000 cycles after the quenching and tempering processes and thus exhibits excellent corrosion fatigue resistance can be manufactured.

TABLE 3

| No. | Steel sample ID | Size of electric-resistance-welded steel pipe or tube Outer diameter φ (mm) × Thickness t (mm) | Heating Heating temperature (° C.) | Diameter-reducing rolling: Rolling temperature (° C.) | Diameter-reducing rolling: Cumulative diameter reducing ratio (%) | Size after diameter-reducing rolling Outer diameter φ (mm) × Thickness t (mm) | Remarks |
|---|---|---|---|---|---|---|---|
| 21 | A | φ89.1 × t4.5 | 860 | 670 | 71 | φ25.4 × t4.0 | Example |
| 22 | A | φ89.1 × t4.5 | 1000 | 900 | 71 | φ25.4 × t4.0 | Example |
| 23 | A | φ89.1 × t4.5 | 980 | 800 | 39 | φ54 × t4.0 | Example |
| 24 | A | φ89.1 × t4.5 | 980 | 800 | 76 | φ21.7 × t4.0 | Example |
| 25 | B | φ89.1 × t4.5 | 860 | 670 | 71 | φ25.4 × t4.0 | Example |
| 26 | B | φ89.1 × t4.5 | 1000 | 900 | 71 | φ25.4 × t4.0 | Example |
| 27 | B | φ89.1 × t4.5 | 980 | 800 | 39 | φ54 × t4.0 | Example |
| 28 | B | φ89.1 × t4.5 | 980 | 800 | 76 | φ21.7 × t4.0 | Example |
| 29 | C | φ89.1 × t4.5 | 860 | 670 | 71 | φ25.4 × t4.0 | Example |
| 30 | C | φ89.1 × t4.5 | 1000 | 900 | 71 | φ25.4 × t4.0 | Example |
| 31 | C | φ89.1 × t4.5 | 980 | 800 | 39 | φ54 × t4.0 | Example |
| 32 | C | φ89.1 × t4.5 | 980 | 800 | 76 | φ21.7 × t4.0 | Example |

TABLE 4

| No. | Steel sample ID | Steel pipe or tube after quenching and tempering: Microstructure of steel pipe or tube Cleanliness (%) TiS | MnS | Average Vickers hardness (HV) | Prior γ grain size (μm) | Corrosion fatigue life (cycle) in 5% NaCl solution | Remarks |
|---|---|---|---|---|---|---|---|
| 21 | A | 0.03 | 0.04 | 430 | 24 | 538410 | Example |
| 22 | A | 0.05 | 0.04 | 430 | 26 | 541560 | Example |
| 23 | A | 0.03 | 0.04 | 410 | 25 | 587410 | Example |
| 24 | A | 0.03 | 0.04 | 410 | 21 | 556320 | Example |
| 25 | B | 0.04 | 0.05 | 440 | 24 | 585690 | Example |
| 26 | B | 0.05 | 0.04 | 430 | 25 | 502360 | Example |
| 27 | B | 0.04 | 0.04 | 440 | 21 | 598740 | Example |
| 28 | B | 0.03 | 0.03 | 410 | 21 | 600150 | Example |
| 29 | C | 0.03 | 0.04 | 430 | 20 | 550010 | Example |
| 30 | C | 0.05 | 0.04 | 420 | 26 | 525630 | Example |
| 31 | C | 0.04 | 0.03 | 410 | 23 | 594780 | Example |
| 32 | C | 0.03 | 0.04 | 430 | 22 | 562580 | Example |

The invention claimed is:

1. An electric-resistance-welded steel pipe or tube for a hollow stabilizer comprising:

a chemical composition containing, in mass %,

C: 0.15% or more and 0.19% or less,

Si: 0.1% or more and 1.0% or less,

Mn: 0.1% or more and 2.0% or less,

P: 0.1% or less,

S: 0.01% or less,

Al: 0.01% or more and 0.10% or less,

Ti: more than 0.05% and 0.1% or less,

B: 0.0005% or more and 0.005% or less,

Ca: 0.0001% or more and 0.0050% or less, and

N: 0.0050% or less, with the balance being Fe and inevitable impurities; and a microstructure in which a cleanliness with respect to TiS particles with a particle size of 10 μm or more and a cleanliness with respect to MnS particles with a particle size of 10 μm or more are 0% or more and 0.1% or less, respectively, the cleanliness being measured by a point counting method according to JIS G 0555.

2. The electric-resistance-welded steel pipe or tube for a hollow stabilizer according to claim 1, wherein the chemical composition further contains, in mass %, at least one selected from the group consisting of Cu: 1% or less, Ni: 1% or less, Nb: 0.05% or less, W: 0.05% or less, V: 0.5% or less, and REM: 0.02% or less.

3. A method of manufacturing the electric-resistance-welded steel pipe or tube for a hollow stabilizer according to claim 1, comprising:

cold forming a steel plate having the chemical composition into an open pipe or tube having an approximately cylindrical shape;

subjecting the open pipe or tube to electric resistance welding with its widthwise ends butted against each other to obtain an electric-resistance-welded steel pipe or tube;

heating the electric-resistance-welded steel pipe or tube to a heating temperature of 850° C. or higher and 1000° C. or lower; and subjecting the heated electric-resistance-welded steel pipe or tube to hot-diameter-reducing rolling under a set of conditions including a rolling temperature of 650° C. or higher and a cumulative diameter reducing ratio of 30% or more and 90% or less.

4. A method of manufacturing the electric-resistance-welded steel pipe or tube for a hollow stabilizer according to claim 2, comprising:

cold forming a steel plate having the chemical composition into an open pipe or tube having an approximately cylindrical shape;

subjecting the open pipe or tube to electric resistance welding with its widthwise ends butted against each other to obtain an electric-resistance-welded steel pipe or tube;

heating the electric-resistance-welded steel pipe or tube to a heating temperature of 850° C. or higher and 1000° C. or lower; and subjecting the heated electric-resistance-welded steel pipe or tube to hot-diameter-reducing rolling under a set of conditions including a rolling temperature of 650° C. or higher and a cumulative diameter reducing ratio of 30% or more and 90% or less.

* * * * *